United States Patent [19]

Boredelon et al.

[11] Patent Number: 4,540,453

[45] Date of Patent: Sep. 10, 1985

[54] MAGNETICALLY SOFT FERRITIC FE-CR-NI ALLOYS

[75] Inventors: Chester M. Boredelon, Shreveport, La.; Gilbert Y. Chin, Berkeley Heights; Sungho Jin, Meyersville; Richard C. Sherwood, New Providence; Jack H. Wernick, Madison, all of N.J.

[73] Assignees: AT&T Technologies, Berkeley Heights; AT&T Bell Laboratories, Murray Hill, both of N.J.

[21] Appl. No.: 437,199

[22] Filed: Oct. 28, 1982

[51] Int. Cl.[3] ..... H01F 1/04

[52] U.S. Cl. ..... 148/31.55; 75/128 R; 179/114 R; 179/115 R; 179/119 R; 179/120; 335/296; 335/297

[58] Field of Search ..... 148/31.57, 31.55; 75/128 R; 179/114 R, 115 R, 119 R, 120; 335/296, 297

[56] References Cited

U.S. PATENT DOCUMENTS 2,382,654 8/1945 Nesbitt ..... 75/128 R 3,673,010 6/1972 Matsumoto et al. ..... 148/31.57

*Primary Examiner*—John P. Sheehan

*Attorney, Agent, or Firm*—Eugen E. Pacher

[57] ABSTRACT

Disclosed are magnetically soft ferritic multiphase Fe-Cr-Ni alloys containing at least about 82 weight percent Fe, between about 3 and about 10 weight percent Cr, and between about 2 and about 8 weight percent Ni, a method for producing such alloys, and devices comprising such an alloy body. The method comprises a low-temperature anneal in the $(\alpha+\gamma)$ region of the Fe-Cr-Ni phase diagram. Inventive alloys typically have a coercive force $H_c$ no more than about 3.0 Oe, preferably no more than about 2.0 Oe, a maximum permeability $\mu_m$ of at least about 1500 G/Oe, preferably at least about 2500 G/Oe, and contain at least about 5 volume percent non-$\alpha$-phase material, typically $\alpha'$- and $\gamma$-phase material. Inventive alloys typically also have yield strength to 0.2% offset of at least about $26.10^7$ Pa ($40.10^3$ psi), elongation to fracture of at least about 15%, good formability and rust resistance. Alloys according to the invention can advantageously be used in devices comprising a magnetically soft body, for instance, in electroacoustic transducers, e.g., in telephone receivers, recording heads, pole pieces, and armatures.

20 Claims, 6 Drawing Figures

MAGNETICALLY SOFT FERRITIC FE-CR-NI ALLOYS

TECHNICAL FIELD

The invention pertains to magnetically soft Fe-Cr-Ni alloys and to devices comprising such alloys.

BACKGROUND OF THE INVENTION

Magnetically soft materials, i.e., materials which typically exhibit macroscopic ferromagnetism only in the presence of an applied magnetic field, find application in a great variety of technological fields. Exemplary uses are in heavy-current engineering, transconductor cores, relays, inductance coils, transformers, and variable reluctance devices. Although many alloy materials are known to be magnetically soft, this invention is concerned only with magnetically soft Fe-Cr-Ni alloys, and in particular, Fe-rich alloys, and our discussion will be restricted accordingly.

The Fe-Cr-Ni alloy system comprises a substantial number of technically important compositions. Among them are the structural steels (e.g., 1.5% Cr, 3.5% Ni, and 0.3% C), the stainless steels (e.g., 18% Cr, 8% Ni), the heat-resistant alloys used as furnace elements (e.g., about 15% Cr, 80% Ni), and the Elinvar type alloys having low temperature coefficients of elastic moduli (e.g., 12% Cr, 36% Ni). In addition to these alloys whose magnetic properties are typically of little or no concern, the system also contains Chromium Permalloy (e.g., 3.8% Cr, 78% Ni), used principally in transformers where high initial or reversible permeability is required. Magnetic Fe-Cr-Ni alloys have also been used in applications requiring magnetic properties that change rapidly with change in temperature. A specific alloy, containing 35% Ni, 5% Cr, 0.3% Si, and the remainder iron, has been suggested for use in relays that open or close at required temperatures and in transformers that control the operations of small motors or other equipment. Fe-Cr-Ni alloys are discussed in R. N. Bozorth, *Ferromagnetism*, Van Nostrand Company, (1951), pp. 146–153, incorporated herein by reference.

As a general rule, a soft magnetic alloy material should in the final product by a single-phase solid solution in its equilibrium state. See, for instance, C. W. Chen, *Magnetism and Metallurgy of Soft Magnetic Materials*, North-Holland Publishing Company, 1977, page 267, where this is referred to as the "first rule for soft magnetic materials". In agreement with this rule, iron-rich Fe-Cr-Ni alloy compositions have not found use as soft magnetic materials, since, inter alia, in practice they are not easily prepared as single-phase materials. Furthermore, they typically have relatively low mechanical strength in this condition. More generally, Bozorth states that the Fe-Cr-Ni alloys that are useful for magnetic purposes lie in the large region of homogeneous $\gamma$ solid solution of face-centered cubic structure (austenite). This region, as can be seen from the phase diagram on page 148 of Bozorth (op. cit.), comprises the Ni-rich region of the phase-diagram, with Ni-content of more than about 14%.

Technologically important applications exist for magnetically soft alloys that possess, in addition to the appropriate magnetic properties, relatively high mechanical strength, that are wear resistant and rust resistant. For instance, such an alloy finds use in telephone ring armature applications. See Mott et al, *Bell System Technical Journal*, Volume 30, January 1951, pp. 110–140. The material currently used in this application is typically 2V-Permendur (49% Fe, 49% Co, 2% V). This alloy is expensive because of its high cobalt content. Furthermore, the alloy typically is difficult to process, requiring a rapid quench to avoid embrittlement due to a order-disorder phase transformation.

Because of cobalt's high cost and uncertain supply status, a Co-free alloy having magnetic properties, mechanical strength, and corrosion resistance similar to, or better than, those of Permendur would be of considerable commercial interest, and could find application in a variety of devices.

SUMMARY OF THE INVENTION

According to the invention, magnetically soft alloys having a multiphase structure comprising $\alpha$-phase material, with at least about 5%, by volume, non-$\alpha$-phase material (comprising typically $\alpha'$, $\gamma$, or $\alpha'$ and $\gamma$), are realized. The alloys comprise at least about 82 weight percent Fe, between about 3 and 10 weight percent Cr, between about 2 and 8 weight percent Ni, and contain no chemical element other than Fe, Cr, Ni, and steel-making additives in an amount greater than about 1 weight percent. Inventive alloys have a coercive force $H_c$ less than about 3.0 Oe ($\sim$240 A/m), preferably less than 2.0 Oe ($\sim$160 A/m), and a maximum permeability $\mu_m$ of at least about 1500 G/Oe ($\sim 1875.10^{-6}$ H/m), preferably more than 2500 G/Oe ($\sim 3125.10^{-6}$ H/m).

The process for producing the inventive alloys comprises maintaining an alloy body in the $\gamma$-range, that is, typically, at a temperature greater than about 700° C., for austenitizing, cooling the body to a temperature less than about 300° C., followed by reheating it to a temperature within the $(\alpha+\gamma)$-range, typically between about 300° and 700° C., preferably between about 525° C. and about 675° C., maintaining it in the $(\alpha+\gamma)$ range for a time effective to produce the desired magnetic and mechanical properties, typically for a period between about 10 minutes and 10 hours, and then cooling the body to a temperature in the $\alpha$-range, typically room temperature. The annealing time in the $(\alpha+\gamma)$-range depends, inter alia, on the annealing temperature and the alloy composition. The anneal typically results in a decrease of lattice damage and strain, and a consequent decrease in $H_c$ and increase in $\mu_m$. But the anneal typically also results in growth of some $\gamma$-phase material, the presence of which in excessive amounts typically has the opposite effect on $H_c$ and $\mu_m$. Thus, there is typically an optimal annealing time for every annealing temperature and alloy composition at which the resulting $H_c$ is minimal and/or $\mu_m$ is maximal.

The inventive alloys have, in addition to their advantageous magnetic properties, relatively high mechanical strength, good corrosion resistance, and good formability. This combination of properties makes the alloys useful for device applications, e.g., in recording heads, pole pieces, and armatures, and in devices comprising a component whose position is dependent on strength or direction of a magnetic field, such as, for instance, a telephone receiver.

DETAILED DESCRIPTION

Figure 1:
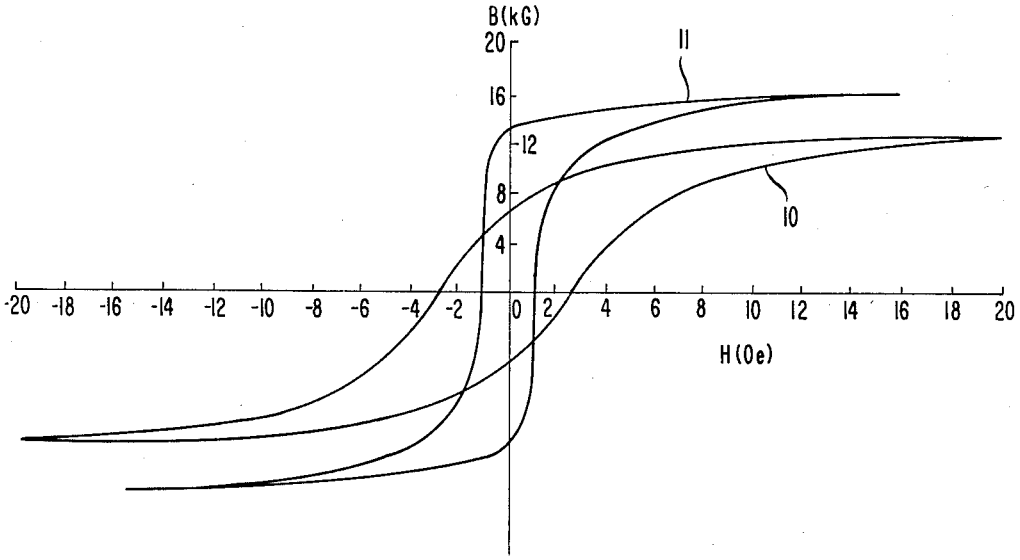
FIG. 1 shows the magnetization curve of an exemplary inventive alloy body, as well as the magnetization curve of the body prior to its low-temperature anneal.

Ferritic Fe-Cr-Ni alloys with iron content of at least about 82 weight percent, a chromium content in the approximate range 3–10 weight percent, and a nickel content in the appropriate range 2–8 weight percent, can be processed to have magnetic properties that make such alloy bodies useful as magnetically soft components and devices. In particular, alloys according to the invention can be processed to have a coercive force $H_c$ of no more than about 3 Oe (about 240 A/m), preferably no more than about 2 Oe (about 160 A/m) and a maximum permeability $\mu_{max}$ of at least about 1500 G/Oe (about $1875.10^{-6}$ H/m), preferably more than about 2500 G/Oe (about $3125.10^{-6}$ H/m). Furthermore, alloys according to the invention typically have saturation magnetic induction $B_s$ of at least about 15,000 G (1.5 T), preferably at least about 20,000 G (2.0 T), and incremental permeability $\Delta\mu$ (measured at 1 kHz, with $\Delta H=0.005$ Oe) of at least about 80 G/Oe (about $100.10^{-6}$ H/m), preferably at least 100 G/Oe (about $125.10^{-6}$ H/m). All of these are understood to be room-temperature values.

In addition to the advantageous magnetic properties, alloys according to the invention typically also have relatively high electrical resistivity, mechanical strength, and rust resistance, and relatively good formability.

Because of the combination of advantageous properties possessed by alloys according to the invention, such alloy bodies can advantageously be employed in devices comprising a magnetically soft metal component or body, exemplified by devices comprising such a component whose position with respect to the device is dependent on the strength or direction of a magnetic field. Among such devices are electro-acoustic transducers, such as, for instance, those used in U-type telephone receivers.

Alloys according to the invention do not contain any elements other than Fe, Cr, Ni, and steel-making additives in individual amounts greater than about 1 % by weight. By "steel-making additives" we mean herein chemical elements which are added to the iron melt during steel-making for purposes of desulfurization, decarbonization, deoxidation, and the like, and which may be present in the starting material for the inventive alloy in concentration in excess of 1 percent by weight. Examples of such elements are Mn, Al, Zr, and Si. However, in preferred inventive alloys, steel-making additives do not exceed 0.5 percent by weight individually. Preferred alloys according to the invention contain Fe, Cr, and Ni in a combined amount of at least 99 percent by weight, preferably at least 99.5 percent, with no other element being present in an amount greater than 0.5 weight percent. Examples of elements that can be present either as additives or as impurities are Mn, Al, Z, Si, Cu, Co, Mo, Ti and V. The elements C, N, O, S, B, and P typically are deleterious impurities and are advantageously limited to individual amounts of no more than 0.1 percent by weight, preferably less than 0.05 weight percent individually, to permit achievement of advantageous magnetic and mechanical properties.

In their final state, the inventive alloys possess a multi-phase structure comprising a ferritic (bcc, $\alpha$-phase) matrix and, typically, austenitic (fcc, $\gamma$-phase) and/or martensitic (bcc, $\alpha'$-phase) minor constituents. The distribution of phases present in any particular alloy sample depends on its composition and heat treatment, but typically the non-$\alpha$-phase material is at least about 5% by volume. The fraction of austenite in the non-$\alpha$-phase material can be anywhere between 0 and 1.

The multi-phase structure is produced by means of heat treatment that comprises a "low temperature" annealing step at a temperature within the $(\alpha+\gamma)$ region of the Fe-Cr-Ni phase diagram. This anneal typically results in relief of internal stress and annealing out of defects, and consequently, in a slight mechanical softening, as well as in a pronounced magnetic softening of the alloy. Prolonged heat treatment, however, leads to the formation of an excessive amount of austenite, which, inter alia, results in deterioration of the soft magnetic properties.

Alloys according to the invention can, for instance, by prepared by vacuum induction-melting of iron, chromium, and nickel, or of appropriate alloys thereof, in appropriate amounts to yield the desired alloy composition, casting ingots from the melt, "soaking" an ingot for an extended period at elevated temperature, for instance at about 1250° C. for about 4 hours, followed by an appropriate hot-forming operation and air cooling. The resultant alloy material is then typically further processed to yield a component of the desired shape. The metal forming steps are typically followed by heat treatment to produce the desired magnetic, mechanical, and electrical properties.

The heat treatment typically comprises an austenitizing anneal at a temperature in the $\gamma$-region of the Fe-Cr-Ni phase-diagram, typically above about 700° C., e.g., about 2 hours at about 1000° C. This treatment is advantageously carried out for a time sufficient to result, in addition to a substantially complete transformation of the material to $\gamma$-phase material, in recrystallization and softening of previously deformed structure, e.g., deformed by cold or hot rolling or forming.

The austenitizing treatment (as well as the "low temperature anneal," discussed below) is advantageously carried out in a protective atmosphere, e.g., in $H_2$, $N_2$, forming gas, or an inert gas such as Ar, and is terminated by cooling, typically air cooling, the alloy body to a temperature equal to or lower than the martensite transformation completion temperature, typically below about 300° C.

Subsequent to cooling of the austenitized alloy body as described above, a low-temperature anneal is carried out, preferably in a protective atmosphere, by reheating the body to a temperature within the $(\alpha+\gamma)$-range of the Fe-Cr-Ni phase diagram, typically between about 300° and 700° C., preferably between about 525° and 675° C., and maintaining it within this temperature range for a period of time sufficient to yield an alloy body having the soft magnetic properties cited above.

The annealing time required to attain these magnetic properties typically is also strongly temperature dependent, and depends, furthermore, on the alloy composition. Typically, however, the time is between about 10 minutes and about 10 hours, frequently between about 15 minutes and about 5 hours. A preferred annealing temperature range is defined by the expression $T=[(700-10x)\pm 25]°$ C., wherein x is the combined weight fraction of Cr and Ni in a given inventive alloy composition.

The low temperature anneal is terminated by cooling the alloy body to a temperature in the $\alpha$-range, typically to room temperature. Since some annealing takes place during at least the high temperature part of the cooling process, cooling rates should typically not be so slow as to result in appreciable further change of the magnetic properties. This, for instance, is typically achieved by a cooling process that brings the alloy body to near room temperature in less than about 1 hour.

It will be understood that the above-described method for producing an alloy body according to the invention is only exemplary and that variations thereof are considered to be within the scope of the invention.

We will now illustrate the invention by means of data obtained on exemplary samples of composition Fe-5Cr-3Ni, and Fe-6Cr-4Ni.

FIG. 1 shows the magnetization curve 10 of a Fe-5Cr-3Ni sample after austenitizing 2 hours at 1000° C. and air cooling to room temperature, and the magnetization curve 11 of a similarly austenitized Fe-5Cr-3Ni sample after a 2 hour low-temperature anneal at 610° C., followed by air cooling to room temperature. The curves demonstrate the change in magnetic properties, including decreased $H_c$, increased B for a given H, and increased $\mu_m$, that results from an appropriate low-temperature anneal. Pre-anneal material typically has a martensitic structure with a high density of dislocations and point defects, a fine-grained substructure, and significant internal stress, resulting in the skewed B-H loop 10. Low-temperature annealing of such material typically results in a decrease of the dislocation and point defect density, and in relief of internal stress, with the annealed material having improved soft magnet properties, as shown by B-H loop 11.

Figure 2:
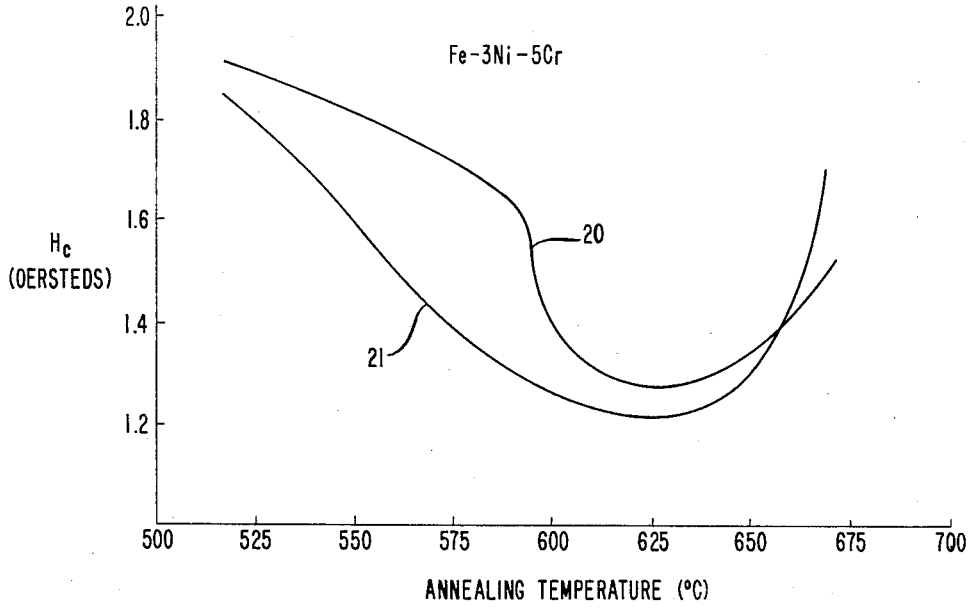
FIG. 2 presents experimentally determined curves of the coercive force $H_c$ as a function of annealing temperature for an exemplary inventive alloy composition.
Figure 3:
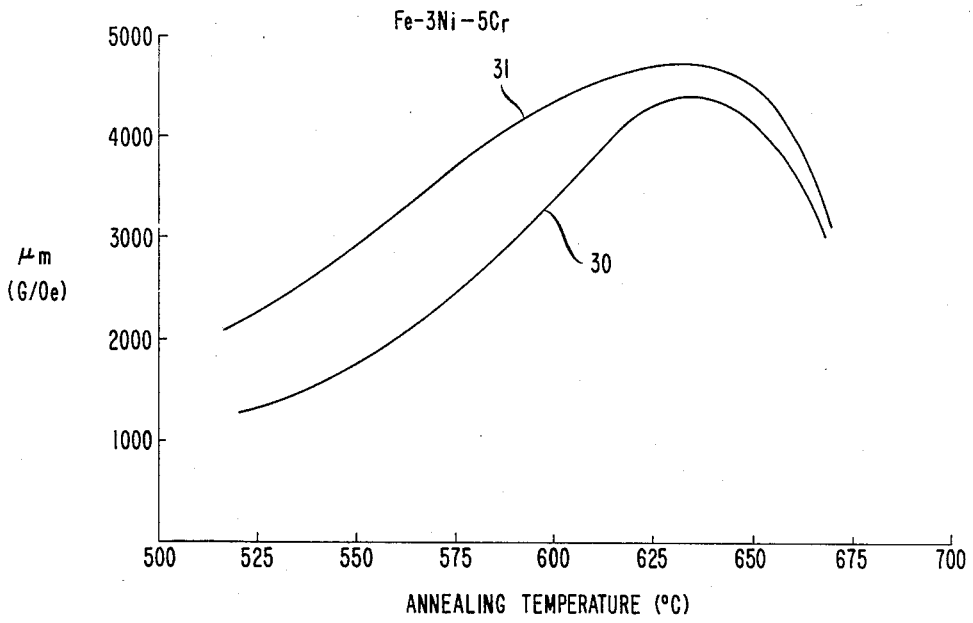
FIG. 3 similarly shows experimental values of maximum permeability $\mu_m$ as a function of annealing temperature.

FIGS. 2 and 3 demonstrate the effect of annealing temperature and time on the coercive force and the maximum permeability, respectively, of Fe-5Cr-3Ni alloy. Curves 20 of FIG. 2, and 30 of FIG. 3, are for material annealed for 30 minutes, and curves 21 of FIG. 2, and 31 of FIG. 3, for material annealed for 2 hours. Both curves of FIG. 2 show decreasing $H_c$ for annealing temperatures (within the range shown) below about 625° C., and increasing $H_c$ for temperatures above about 625° C. Similarly, both curves of FIG. 3 show increasing $\mu_m$ for temperatures (within the range shown) below about 630° C., and decreasing $\mu_m$ above about 630° C. The low-temperature decrease in $H_c$ (increase in $\mu_m$) is due, inter alia, to the above-discussed stress relief, and reduction in defect density. These beneficial effects however are overcome by the deleterious effects of austenite-formation at high temperatures, indicating an advantageous annealing temperature for Fe-5Cr-3Ni, for annealing times between 30 minutes and 2 hours, of about 625±25° C.

Figure 4:
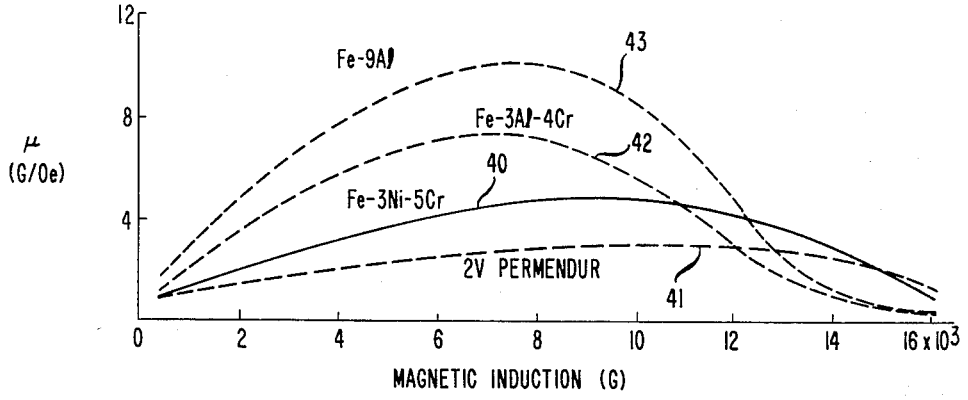
FIG. 4 shows the permeability of an exemplary inventive alloy composition and of three exemplary prior art alloys as a function of magnetic induction.

FIG. 4 shows experimentally determined curves of magnetic permeability $\mu$ as a function of magnetic induction B. Curve 40 was measured on a sample of Fe-3Ni-5Cr alloy according to the invention, annealed for 2 hours at about 625° C., followed by air cooling to room temperature. Curves 41 through 43 are for prior art magnetically soft alloys, namely, 41 for 2V-Permendur, 42 for Fe-3Al-4Cr, and 43 for Fe-9Al. As can be seen from FIG. 4, the inventive alloy sample had higher permeability than 2V-Permendur for $500<B<15{,}000$ G, ($0.05<B<1.5$ T) and higher permeability than all three prior art alloys for $12{,}500<B<15{,}000$ G ($1.25<B<1.5$ T).

Figure 5:
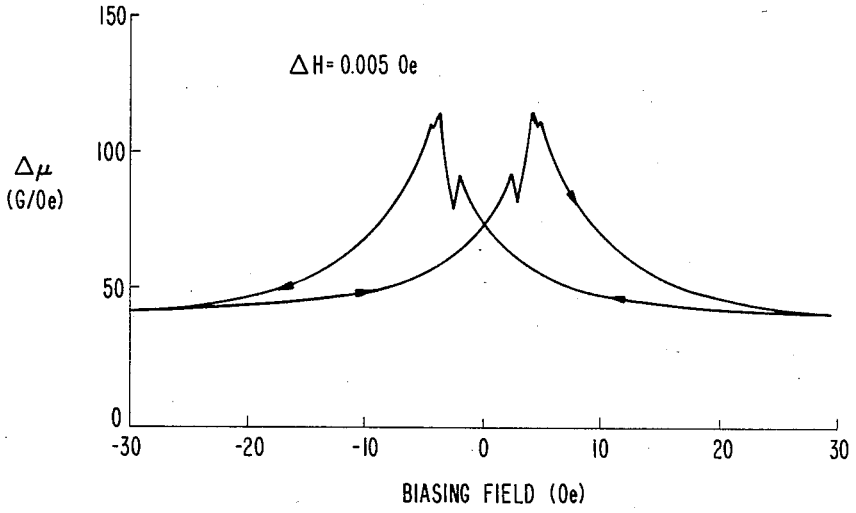
FIG. 5 shows an experimentally determined curve of incremental permeability $\Delta\mu$ of an exemplary inventive alloy as a function of bias field.

FIG. 5 shows a measured curve of incremental permeability $\Delta\mu$ as a function of biasing field, at 1 kHz, with the amplitude of the a.c. field $\Delta H=0.005$ Oe ($\sim 0.4$ A/m), for a ring sample of Fe-6Cr-4Ni according to the invention (austenitized 1 hour at 1000° C., annealed 1.5 hours at 600° C.). The sample has a maximum $\Delta\mu$ of about 114 G/Oe ($\sim 142.10^{-6}$ H/m).

Figure 6:
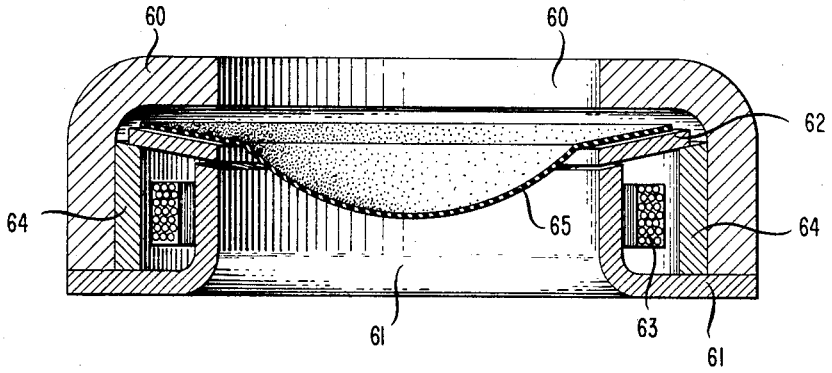
FIG. 6 schematically depicts in cross-sectional view a device comprising a magnetic body according to the invention, namely, a U-type telephone receiver.

FIG. 6 schematically shows in cross-section an exemplary device comprising a component whose position is dependent on the strength or direction of a magnetic field. In particular, the figure represents an electroacoustic transducer, and still more particularly, a U-type ring-armature telephone receiver, as described, for instance, by E. E. Mott et al (op. cit.). Permanent magnet 60, for example an Fe-Cr-Co magnet, provides a biasing field in the air gap formed between pole piece 61, which, for example, can be a body comprising an Fe-45Ni alloy, and one pole of 60. Armature ring 62, typically comprising a magnetically soft alloy such as, for instance, 2V-Permendur in a prior art device, or an Fe-Cr-Ni alloy according to the invention, rests on non-magnetic support 64, and can be subjected to a time-varying magnetic field by means of electrical induction coil 63. The position of the armature in the air gap is a function of the strength and direction of the time-varying magnetic field, resulting in movement of the armature and of diaphragm 65, attached to the armature, thereby creating acoustic waves in a surrounding fluid medium, e.g., in air. Alloys useful as armatures in telephone receivers and in other device applications advantageously have relatively small $H_c$, relatively large $\mu_m$, and relatively large $\mu$ and $\Delta\mu$ at high induction, and alloys according to the invention typically possess these magnetic properties, as was exemplified, inter alia, by the data of FIGS. 1-5.

Alloys useful for the device applications discussed herein, e.g., the armature ring of the U-type telephone receiver illustrated in FIG. 6, advantageously also have relatively high yield strength, and relatively high rust resistance, since these give, inter alia, wearability and dimensional stability, respectively, to components fabricated from such alloy material. Furthermore, it is of advantage if such alloys have relatively good cold formability, since this can result in easy and economical manufacture of complicated-shaped components. Alloys according to the invention typically have relatively high yield strength (typically at least about $26.10^7$ Pa, preferably greater than about $35.10^7$ Pa) and elongation (typically at least about 15%, preferably more than 20%, as measured by pulling to fracture a standard 2 inch gauge length test specimen), indicative of at least some aspects of good cold formability.

TABLE I

| | Mechanical Properties | |
|---|---|---|
| | Yield Strength (Pa) to 0.2% Offset | Elongation to Fracture (%) |
| Fe—5Cr—3Ni 600° C./2 hours/air cool | ($41 \cdot 10^7$ Pa) | 34 |

TABLE I-continued

| | Mechanical Properties | |
|---|---|---|
| | Yield Strength (Pa) to 0.2% Offset | Elongation to Fracture (%) |
| Fe—6Cr—4Ni | | |
| 610° C./2 hours/air cool | ($45 \cdot 10^7$ Pa) | 32 |
| 900° C./1 hour/air cool | ($61 \cdot 10^7$ Pa) | 12 |
| 2V—Permendur | ($36 \cdot 10^7$ Pa) | 17 |

Table I, in addition to showing data for two samples of alloys according to the invention that were annealed at temperatures, and for times, appropriate to yield optimal, or near optimal, magnetic properties, also shows data for one sample that was not annealed. Austenitizing a Fe-6Cr-4Ni sample for 1 hour at 900° C. resulted in high strength but low elongation (and, although the data are not presented here, relatively high $H_c$ and low $\mu_m$), due to excessive defect density and internal stress due to the martensitic transformation.

Table I also presents representative data for 2V-Permendur. As can be seen, the two appropriately prepared inventive alloy samples have yield strength slightly higher than that of the 2V-Permendur sample, and elongation approximately double thereof.

Another aspect of formability of a material is its bendability. Alloys according to the invention at room temperature typically allow bending through an angle of at least about 50° when bend radius equals article thickness. Formability and ductility are enhanced, inter alia, by minimization of the presence of impurities, in particular, of elements of groups IV and VB of the periodic table.

Alloys useful for device applications, e.g., the above-referred-to applications, including recording heads, pole pieces, and armatures advantageously are also rust resistant, since this typically results in increased service life and air-gap maintenance of such devices, and alloys according to the invention typically are relatively rust resistant. For instance, 0.01 inches (0.25 mm) thick foils of the inventive alloy typically showed weight gains less than about 0.3%, for preferred alloys less than about 0.2%, when temperature-humidity cycled (−40° C./66° C., 20%/90% relative humidity) in air for 14 days.

Armature rings, similar to part 63 of FIG. 6, were fabricated from inventive alloys and incorporated into U-type telephone receivers. Such receivers typically had acoustic efficiency greater than about 72 db, and typically greater than about 73 db with preferred alloys.

What is claimed is:

1. Device comprising a magnetically soft alloy body, the alloy having a coercive force $H_c$ of no more than about 3.0 Oe and a maximum permeability $\mu_m$ of at least about 1,500 G/Oe, both measured at room temperature, characterized in that (a) the alloy comprises at least about 82 weight percent Fe, between about 3 and about 10 weight percent Cr, between about 2 and about 8 weight percent Ni, and (b) the alloy has a multiphase structure comprising $\alpha$-phase material, with the amount of non-$\alpha$-phase material present in the alloy body being at least about 5 volume percent.

2. Device of claim 1, wherein the non-$\alpha$-phase material present in the alloy body comprises at least one material selected from the group consisting of $\alpha'$-phase material and $\gamma$-phase material.

3. Device of claim 1, wherein the alloy contains no element, other than Fe, Cr, and Ni, in an amount greater than 1 weight percent.

4. Device of claim 3, wherein the alloy comprises a combined amount of at least 99 weight percent Fe, Cr, and Ni.

5. Device of claim 4, wherein no element other than Fe, Cr, and Ni is present in an amount greater than 0.5 weight percent.

6. Device of claim 5, wherein the alloy contains no element of the group consisting of C, N, O, S, B and P in an amount greater than 0.1 weight percent.

7. Device of claim 1, wherein the alloy has a room temperature yield strength to 0.2% offset of at least about $26.10^7$ Pa.

8. Device of claim 7, wherein the alloy has room temperature elongation of at least about 15%.

9. Device of claim 1, wherein the alloy has an incremental permeability $\Delta\mu$ of at least about 80 G/Oe, measured with an applied 1 kHz field of 0.005 Oe amplitude at room temperature.

10. Device of claim 1, wherein the alloy shows a weight gain of no more than about 0.3% after temperature-humidity cycling, between −40° C. and 66° C., and between 20% and 90% relative humidity, a 0.01 inch thick alloy foil in air for 14 days.

11. Device of claim 1, wherein the magnetically soft alloy body forms at least a part of a component whose position with respect to the device is dependent on strength or direction of a magnetic field.

12. Device of claim 11, wherein the magnetic field is produced by an induction coil.

13. Device of claim 12, wherein the device comprises an electro-acoustic transducer.

14. Device of claim 13, wherein the transducer is a telephone receiver.

15. A telephone receiver comprising a component whose position with respect to the receiver is dependent on strength or direction of a magnetic field, the component comprising a magnetically soft alloy body, the alloy having a coercive force $H_c$ of no more than about 2.0 Oe and a maximum permeability $\mu_m$ of at least about 2500 G/Oe, both measured at room temperature, and a yield strength to 0.2% offset of at least about $35.10^7$ Pa, characterized in that (a) the alloy comprises at least about 82 weight percent Fe, between about 3 and about 10 weight percent Cr, between about 2 and about 8 weight percent Ni, these three elements being present in the alloy in a combined amount of at least 99 weight percent, with no element other than Fe, Cr, and Ni being present in an amount greater than 0.5 weight percent, and no element of the group consisting of C, N, O, S, B and P being present in an amount greater than 0.1 weight percent, and (b) the alloy body has a multiphase structure comprising $\alpha$-phase material, with the amount of non-$\alpha$-phase material present in the alloy body being at least about 5 volume percent.

16. Magnetically soft alloy having a coercive force $H_c$ of no more than about 3.0 Oe and a maximum permeability $\mu_m$ of at least about 1500 G/Oe, both measured at room temperature, characterized in that (a) the alloy comprises at least about 82 weight percent Fe, between about 3 and about 10 weight percent Cr, between about 2 and about 8 weight percent Ni, and (b) the alloy has a multiphase structure comprising $\alpha$-phase material, with the amount of non-$\alpha$-phase material in the alloy being at least about 5 volume percent.

17. Alloy of claim 1, wherein the combined amount of Fe, Cr, and Ni is at least about 99 weight percent, no element other than Fe, Cr, and Ni is present in an amount greater than about 0.5 weight percent, and no element of the group consisting of C, N, O, S, B and P is present in an amount greater than about 0.1 weight percent.

18. Alloy of claim 1, having a room temperature yield strength to 0.2% offset of at least about $26.10^7$ Pa, and a room temperature elongation to fracture of at least about 15%.

19. Device of claim 1, wherein the alloy optionally comprises one or more additives chosen from the group consisting of Mn, Al, Zr, and Si, with no element other than Fe, Cr, Ni, and the optional additives being present in the alloy in an individual amount greater than 1 weight percent.

20. Alloy of claim 16 optionally comprising one or more additives chosen from the group consisting of Mn, Al, Zr, and Si, with no element other than Fe, Cr, Ni, and the optimal additives being present in the alloy in an individual amount greater than 1 weight percent.

* * * * *

UNITED STATES PATENT AND TRADEMARK OFFICE

CERTIFICATE OF CORRECTION

PATENT NO. : 4,540,453

DATED : September 10, 1985

INVENTOR(S) : Chester M. Bordelon, Gilbert Y. Chin, Sungho Jin, Richard C. Sherwood and Jack H. Wernick It is certified that error appears in the above-identified patent and that said Letters Patent is hereby corrected as shown below:

On the Title page, the inventor "Chester M. Boredelon" should read --Chester M. Bordelon--.

Signed and Sealed this

Seventh Day of January 1986

[SEAL]

*Attest:*

DONALD J. QUIGG

*Attesting Officer*

*Commissioner of Patents and Trademarks*